US006312109B1

(12) United States Patent
Chen

(10) Patent No.: US 6,312,109 B1
(45) Date of Patent: Nov. 6, 2001

(54) INK-JET HEAD WITH BUBBLE-DRIVEN FLEXIBLE MEMBRANE

(75) Inventor: Yu-feng Chen, Taipei (TW)

(73) Assignee: Pamelan Company Limited, Taipei (TW)

( * ) Notice: Subject to any disclaimer, the term of this patent is extended or adjusted under 35 U.S.C. 154(b) by 0 days.

(21) Appl. No.: 09/482,305

(22) Filed: Jan. 12, 2000

(51) Int. Cl.[7] ..... B41J 2/04; B41J 2/05
(52) U.S. Cl. ..... 347/54; 347/65
(58) Field of Search ..... 317/44, 45, 54, 317/63, 65, 21, 62

(56) References Cited

U.S. PATENT DOCUMENTS 5,387,440 * 2/1995 Takemoto et al. ..... 347/45
5,742,307 * 4/1998 Watrobski et al. ..... 347/62
5,821,962 * 10/1998 Kudo et al. ..... 347/65
6,074,043 * 6/2000 Ahn ..... 347/54

FOREIGN PATENT DOCUMENTS

405338180 * 12/1993 (JP) ..... 347/45

* cited by examiner

*Primary Examiner*—John Barlow
*Assistant Examiner*—Juanita Stephens
(74) *Attorney, Agent, or Firm*—Birch, Stewart, Kolasch & Birch, LLP

(57) ABSTRACT

An ink-jet head unit includes a dielectric substrate; a heating layer formed on the dielectric substrate, the heating layer comprising a resistor for converting electricity into thermal energy; a heat dissipating layer formed on the heating layer for insulation and conduction; a working fluid chamber formed in the heat dissipating layer and corresponding to the top surface of the resistor for working fluid reservoir; a nozzle plate formed on the heat dissipating layer, the nozzle plate being formed with a nozzle; an ink chamber formed in the nozzle plate for holding ink; and a flexible membrane formed between the heat dissipating layer and the nozzle plate to separate the working fluid chamber from the ink chamber. The flexible membrane comprises a polymeric adhesive layer formed on the heat dissipation layer, a barrier metal layer formed on the polymeric adhesive layer, and a protection layer formed on the barrier metal layer.

17 Claims, 4 Drawing Sheets

INK-JET HEAD WITH BUBBLE-DRIVEN FLEXIBLE MEMBRANE

BACKGROUND OF THE INVENTION

A. Field of the Invention

The present invention relates to an ink-jet head, and especially to an ink-jet head with bubble-driven flexible membrane.

B. Description of the Prior Art

The structure of a conventional bubble-driven ink-jet head is illustrated in FIG. 1. Referring to FIG. 1, the ink-jet head comprises: a substrate 1, a heating layer 2 with a resistor 3 formed on the substrate 1, a dielectric layer 4 formed on the substrate 1, a nozzle plate 5 formed on the dielectric layer 4 having a nozzle 6 formed therein, and an ink chamber 7 formed within said dielectric layer 4 and between the heating layer 2 and the nozzle plate 5 for containing ink, and an ink channel 8 communicating with an external ink cartridge (not shown).

When applied with a voltage pulse, the resistor 3 provides a sudden outburst of thermal energy to cause the adjacent ink to vaporize locally, and creating a bubble in the ink chamber 7. The sudden expansion of the bubble creates a pressure wave in the ink and causes an ink droplet to be expelled from the nozzle 6. Then, when the voltage pulse has vanished, the bubble collapses soon afterwards. Thus, the ink ejections can be generated repeatedly by controlling the application of voltage pulses to the resistor 3.

A problem of the conventional bubble-driven ink-jet head is that it vaporizes the ink directly. In this case, it requires new kinds of ink which must be thermal-stable, of low electrical conductibility, and of low chemical activity. Moreover, when the bubbles are created and collapse near the resistor 3, the impact caused by the bubbles can damage the resistor 3, and the chemical properties of the ink can also cause damage to the resistor 3, thus inevitably reduce the lifetime of the resistor 3. In addition, since the creation and collapse of the bubbles are determined by temperature, rapid heat dissipation is required. Accordingly, when the resistor 3 vaporizes the ink, it has to be cooled down rapidly. Moreover, the printing quality may be impaired due to the ink droplets remained on the outer surface of the nozzle plate after ejection.

To overcome the above-mentioned problems, U.S. Pat. No. 4,480,259 disclosed an ink-jet printer with bubble driven membrane. Referring to FIG. 2, the ink-jet head of the ink-jet printer comprises: a substrate 11; a heating layer 12 with a resistor 13 formed on the substrate 11; a flexible membrane 14 formed on the heating layer 12 and forming a working fluid chamber 15 cooperating with the heating layer 12 to contain working fluid; a dielectric layer 16 formed on the flexible membrane 14 and forming an ink chamber 17 therein; and a nozzle plate 18 formed on the dielectric layer 16 with a nozzle 19 formed therein.

When the resistor 13 is applied with a voltage pulse, the resistor 13 provides a sudden outburst of thermal energy to cause the working fluid to vaporize locally, and creating a bubble in the working fluid chamber 15. The sudden expansion of the bubble increases the pressure within the working fluid chamber 15. The expansion of the bubble causes the flexible membrane to be deformed, resulting in a local deformation of the membrane and the propagation of a pressure wave to the ink in the ink chamber 17. The pressure wave then ejects a droplet of ink from the nozzle 19. By controlling the energy input to the resistor 13, the bubble collapse quickly back onto or near resistor 13 so that repeated operations are feasible.

The advantage of the ink-jet head with bubble driven flexible membrane is that it is not necessary to directly heat the ink. Instead, a selected working fluid is heated. So, it can be used with any kinds of conventional ink and working fluid which do not cause damage to the resistor. However, the prior art still left a few problems unresolved yet including the problems of rapid heat dissipation, and ink droplets remaining on the outer surface of the nozzle plate. In addition, there is still a problem about erroneous operation of ink ejection caused by pressure wave propagation. Each working fluid chamber is communicating with one another via a working fluid channel and thus forming a closed working fluid channel system. In this case, when the working fluid creates a bubble within the working fluid chamber, since the working fluid itself is incompressible, a pressure wave will be transmitted to a neighboring working liquid chamber of an adjacent ink-jet head unit and causes ink droplets to be ejected from wrong ink-jet head units. Moreover, the membrane of the prior art is made of material that cannot prevent of vaporized working fluid and is not made of material durable enough to sustain high frequency operations of ink ejection.

SUMMARY OF THE INVENTION

It is an object of the invention to provide an ink-jet head with a bubble-driven flexible membrane that is made of a material durable enough to sustain high frequency operations of ink ejection, and is capable of preventing infiltration of vaporized working fluid.

Another object of the invention is to provide an ink-jet head with a bubble-driven flexible membrane that does not cause ink droplets to be remained on the outer surface of the nozzle plate, thereby improving the printing quality.

Yet another object of the invention is to provide an ink-jet head with a bubble-driven flexible membrane that provides rapid heat dissipation, thereby increasing the working frequency and improving the printing quality.

Still yet another object of the invention is to provide an ink-jet head with a bubble-driven flexible membrane that prevents erroneous operations of ink ejection caused by a pressure wave transmitted from a working fluid chamber to other neighboring working fluid chambers, thereby improving the printing quality.

To achieve the above objects, the ink-jet head with a bubble-driven flexible membrane in accordance with the invention comprises: a dielectric substrate; a heating layer formed on said dielectric substrate, the heating layer comprising a resistor for converting electricity into thermal energy; a heat dissipating layer formed on the heating layer; a working fluid chamber formed in the heat dissipating layer and corresponds to the area above of the resistor for containing working fluid; a nozzle plate formed on the heat dissipating layer, the nozzle plate comprises a nozzle, and the surface that faces the exterior surrounding is the outer surface of the nozzle plate; an ink chamber formed in the nozzle plate for containing ink, and the peripheral surfaces of the ink chamber are the inner surfaces of the nozzle plate; and a flexible membrane formed between the heat dissipating layer and the nozzle plate to separate the working fluid chamber from the ink chamber.

When a voltage pulse is applied to the resistor, a sudden outburst of thermal energy causes the working fluid to vaporize locally and to create a bubble in the working fluid chamber. The expansion of the bubble causes the pressure within the working fluid chamber to increase, and thus pushes the flexible membrane outwards. The sudden expansion creates a pressure wave in the working fluid that is propagaged to the ink within the ink chamber, and causes an ink droplet to be expelled from the nozzle. After that, when the voltage pulse has vanished, the bubble collapses soon afterwards. Thus, the ink ejections can be generated repeatedly by controlling the application of voltage pulses to the resistor.

In accordance with the invention, the flexible membrane is of a stacked structure so that its durability is strong enough to sustain high frequency operations of ink ejection, and capable of preventing infiltration of vaporized working fluid.

In accordance with the invention, the heat dissipation layer surrounding the working fluid chamber has a good heat dissipation efficiency, thereby improving the operation frequency and printing quality.

In accordance with the invention, the inner surface of the nozzle plate is overlaid with a well-wettable layer so that the inner surface of the nozzle plate has a good wettability for ink. On the other hand, the outer surface of the nozzle plate is overlaid with a poor-wettable layer as ink-repellent. Thus, the ink droplets will not left on the outer surface of the nozzle plate, thereby improving the printing quality.

In accordance with the invention, the working fluid is provided with good hydro-resistance characteristics. Thus, the pressure wave will not propagate to neighboring ink-jet heads to generate erroneous ink ejections.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

These and other objects and advantages of the present invention will become apparent by reference to the following description and accompanying drawings which are given by way of illustration only, and thus are not limitative of the present invention, and wherein.

DETAILED DESCRIPTION OF THE PREFERRED EMBODIMENTS

A preferred embodiment of the invention is described below. This embodiment is merely exemplary. Those skilled in the art will appreciate that changes can be made to the disclosed embodiment without departing from the spirit and scope of the invention.

Figure 1:
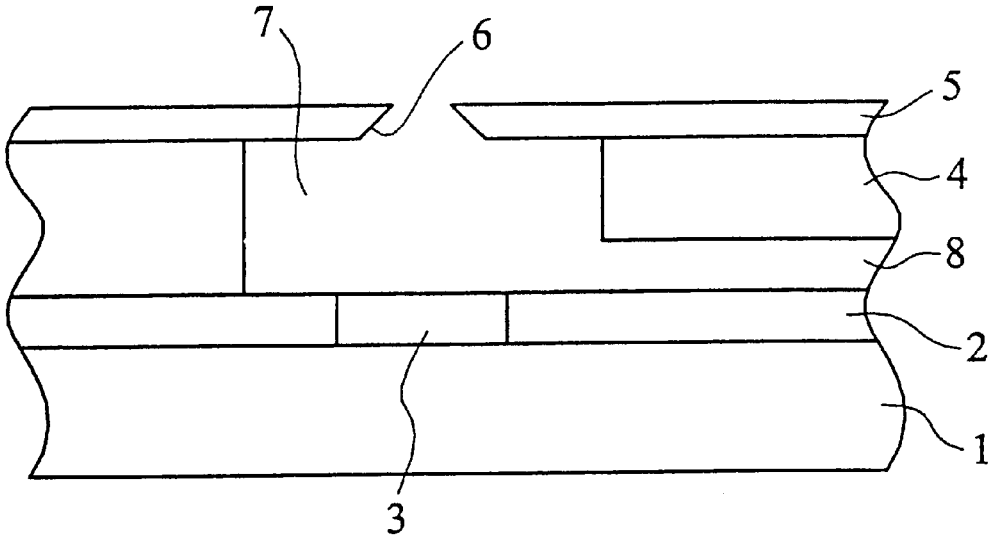
FIG. 1 PRIOR ART
FIG. 1 is a cross-sectional view showing a conventional bubble-driven ink-jet head.
Figure 2:
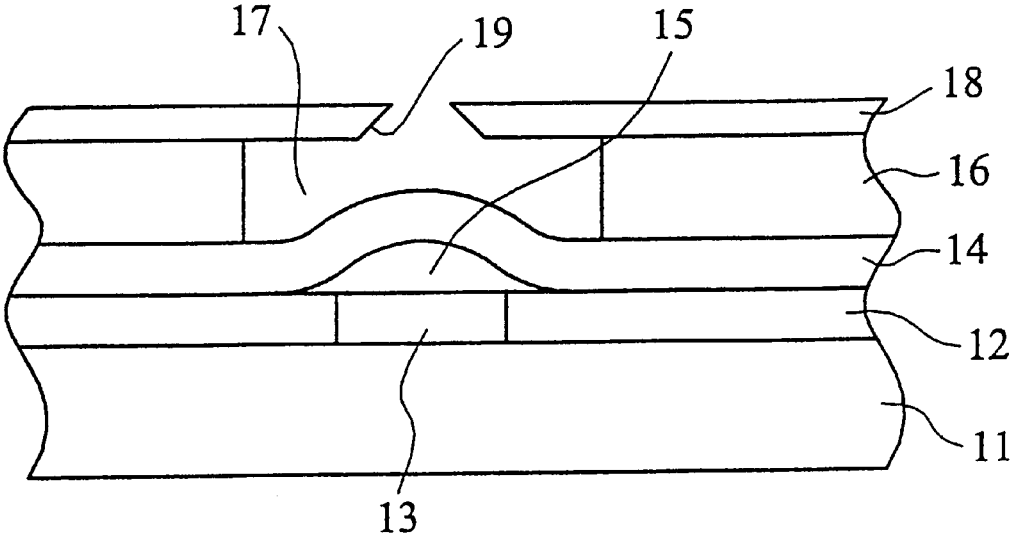
FIG. 2 PRIOR ART
FIG. 2 is a cross-sectional view showing a conventional ink-jet head with a bubble-driven flexible membrane.
Figure 3:
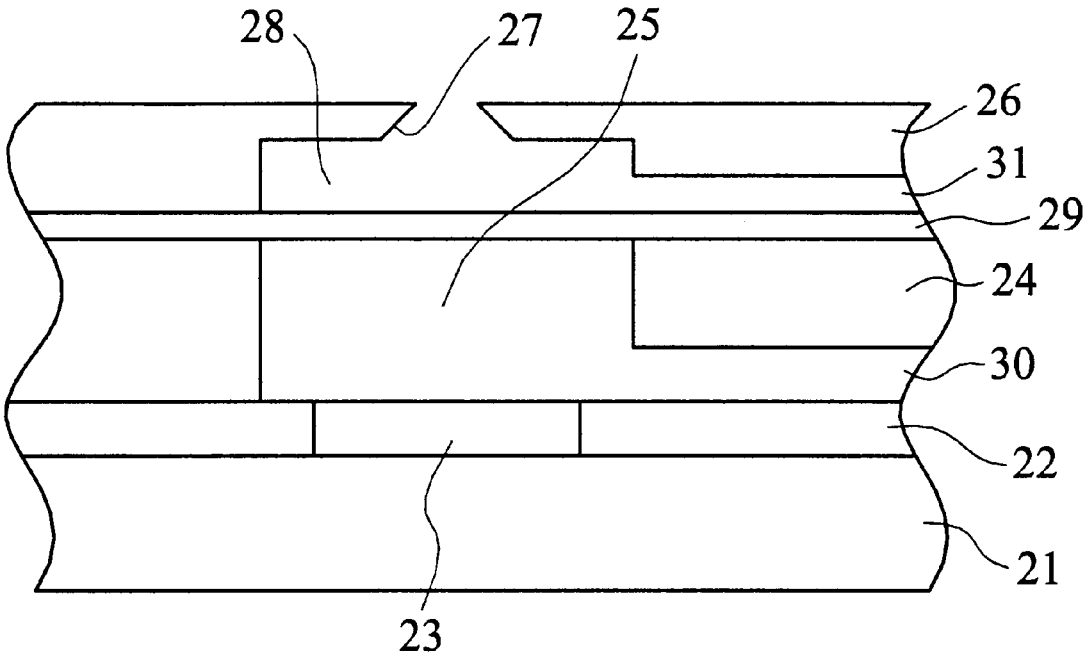
FIG. 3 is a cross-sectional view showing an ink-jet head with a bubble-driven flexible membrane according to a preferred embodiment of the invention.

Referring to FIG. 3, the structure of an ink-jet head unit with a bubble-driven flexible membrane in accordance with the preferred embodiment of the present invention comprises: a dielectric substrate 21, a heating layer 22 overlaying the dielectric substrate 21, the heating layer 22 containing a resistor 23 for converting electricity into thermal energy; a heat dissipation layer 24 formed on the heating layer 22; a working fluid chamber 25 formed in the heat dissipation layer 24 and over the top surface of the resistor 23 for containing ink; a nozzle plate 26 formed over the heat dissipating layer 24 and having a nozzle 27; an ink chamber 28 formed in the nozzle plate 26 for containing ink; and a flexible membrane 29 formed between the heat dissipating layer 24 and the nozzle plate 26 to separate the working fluid chamber 25 from the ink chamber 28.

When a voltage pulse is applied to the resistor 23, a sudden outburst of thermal energy causes the working fluid ink to vaporize locally within a few microseconds, creating a bubble in the working fluid chamber 25. The expansion of the bubble causes the pressure within the working fluid chamber 25 to increase, and thus pushes the flexible membrane 29 outwards. The sudden expansion creates a pressure wave in the working fluid that propagates to the ink within the ink chamber 28, and causes an ink droplet to be expelled through the nozzle 27. After that, when the voltage pulse vanishes, the bubbles will collapse soon afterwards. Thus, the ink ejections can be generated repeatedly by controlling the voltage pulses applied to the resistor 23.

The heating layer 22 is formed by an conductive material such as aluminum with a thickness of 1.5 to 2 microns. The function of the heating layer 22 is to apply voltage pulses to the resistor 23. The resistor 23 is formed by polysilicon with thickness of about 0.6 micron and resistance value about 25 to 35 ohms.

Each working fluid chamber 25 has a working fluid channel 30 for communicating with a working fluid chamber 25 of another ink-jet head unit. Thus, the working fluid chamber and the working fluid channel of each ink-jet head units form a closed working fluid channel system. The working fluid is preferably stable and has good physical properties under high temperature so that the ink-jet head operates normally. For example, when the temperature of the working fluid is about 300° C. to 350° C., the working fluid is still stable with a resistance value larger than 108 ohms and will not decompose or develop a significant change in its chemical composition. When applied with a voltage lower than 21 volts, the working fluid will still not be ionized yet. The boiling point of the working fluid is preferably from 100° C. to 150° C. under normal back pressure, and from 250° C. to 350° C. under maximum back pressure. The working fluid may contain a variety of materials, in which one material has properties of having a boiling point from 90° C. to 110° C., and high vapor pressure, and another material has properties of high boiling point and good conductibility. Accordingly, the working fluid can be selected from xylene, toluene, heptane, ethylene alcohol, alcohol, and the like.

Each ink chamber 28 is formed with an ink channel 31 for communicating with an external ink cartridge for supplying ink to the ink chamber 28.

Figure 4:
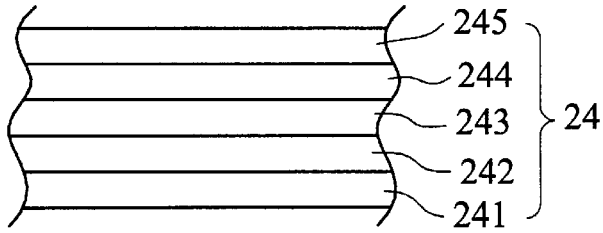
FIG. 4 is a schematic diagram showing the structure of the heat dissipation layer of the ink-jet head according to the preferred embodiment of the invention.

Referring to FIG. 4, the heat dissipation layer 24 can be formed by a variety of metals. For instance, in the preferred embodiment of the present invention, the heat dissipation layer 24 is formed by a polysilicon layer 241, a chromium layer 242, a brass layer 243, a chromium layer 244, and a polysilicon layer 245. The chromium layer 242 is adhesive. The chromium layer 244 also can provide the functions of adhesion and protection. The total thickness of the metal layers 242, 243, and 244 shall be greater than half the thickness of the heat dissipation layer 24, that is, half the height of the working fluid chamber 25, to provide satisfactory heat dissipation and to improve the operation efficiency for ink ejection.

Figure 5:
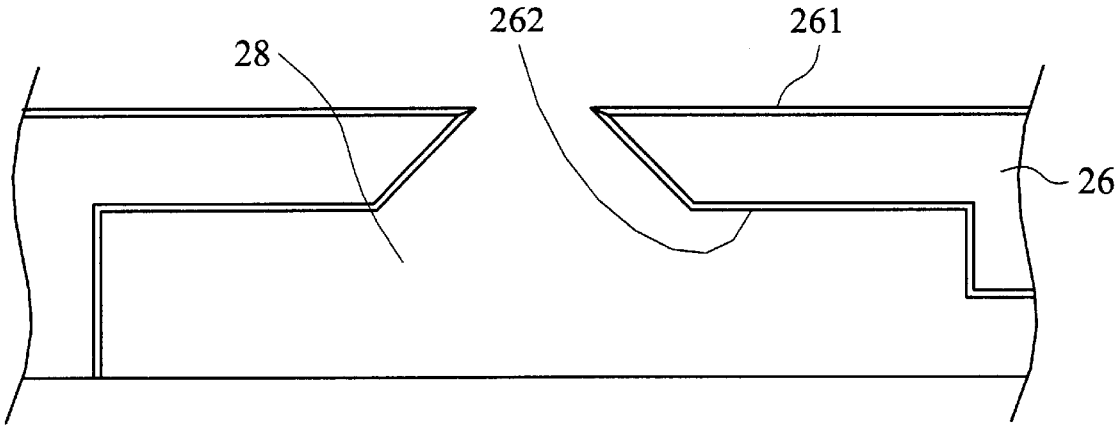
FIG. 5 is an enlarged view showing the structure of the nozzle plate of the ink-jet head according to the preferred embodiment of the invention.

FIG. 5 is an enlarged view showing the structure of the nozzle plate 26, whose outer surface is overlaid with a poor-wettable layer 261 and inner surface is overlaid with a well-wettable layer 262. Thus, ink droplets will not be left on the outer surface of the nozzle plate so as to improve the printing quality. For example, the nozzle plate 26 is formed by a layer of nickel. The inner surface of the nozzle plate 26, that is, the side walls of the ink chamber 28, is overlaid with a well-wettable layer 262 of thickness about 2~3 microns to keep the moisture of the ink. The well-wettable layer 262 is formed by, for example, polyimidoums. On the other hand, the outer surface of the nozzle plate 26 is overlaid with a poor-wettable layer 261 of thickness about 2~3 microns for ink repellant. The poor-wettable layer 261 is formed, for example, by tetra-fluorine-ethylene.

Figure 6:
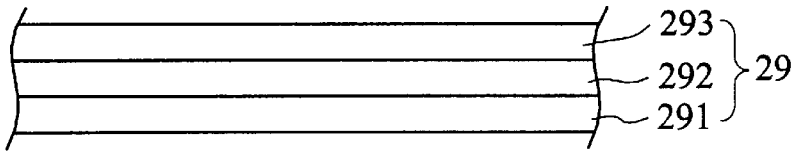
FIG. 6 is a schematic diagram showing the structure of the flexible membrane of the ink-jet head according to the preferred embodiment of the invention.

FIG. 6 is a schematic diagram showing the structure of the flexible membrane 29 that includes a polymeric adhesive layer 291, a barrier metal layer 292, and a protection layer 293. The polymeric adhesive layer 291 or the protective layer 293 is formed, for example, by polyimidoums to adhere the flexible membrane in the ink-jet head structure and to protect the barrier metal layer 292 therein. And the barrier metal layer 292 is formed, for example, by chromium that can sustain high frequency operations of ink ejection, and can prevent the vaporized working fluid from infiltrating through the flexible membrane 29.

Figure 7:
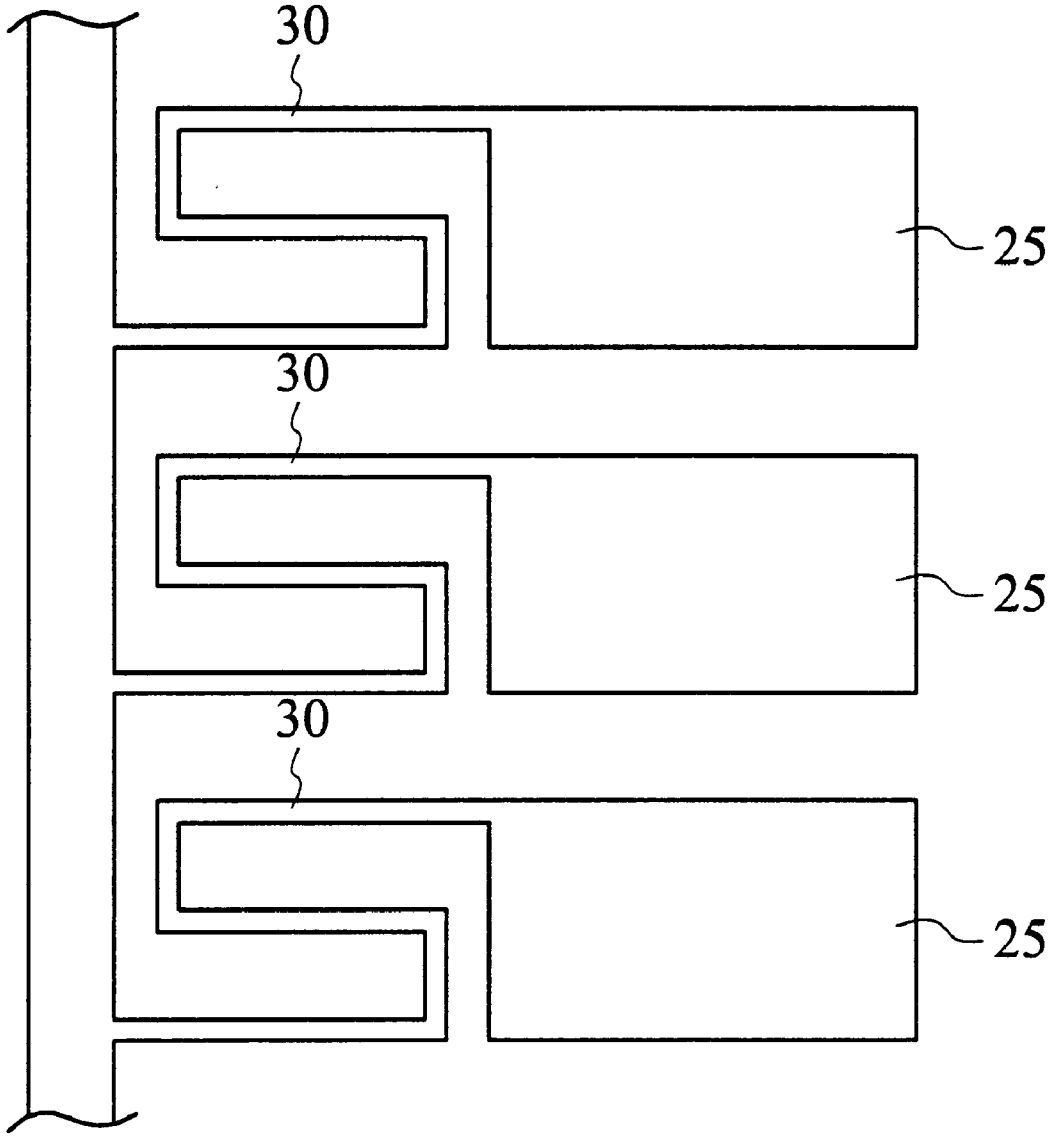
FIG. 7 is a schematic diagram showing the structure of the working fluid channel system of the ink-jet head according to the preferred embodiment of the invention.

FIG. 7 is a schematic diagram showing the structure of a partial ink-jet head where each working fluid chamber 25 communicates with one another via the working fluid channel 30. The working fluid chamber 25 and the working fluid channel 30 of each ink-jet head unit connect to one another and thus form a closed working fluid channel system. The hydro-resistance value of each working fluid channel can be calculated by the following equation:

$$Rr = \eta \times \frac{l}{h \times b} + K,$$

wherein l is the length of the working fluid channel 30, h is the height of the cross section of the working fluid channel 30, b is the width of the cross section of the working fluid channel 30, and K is a coefficient that depends on the number and the curvatures of the curves of the working fluid channel 30. The more curves the working fluid channel 30 has, the larger value the K is. η is a coefficient, with a dimension of length (meter), that depends on the viscosity of the working fluid and the wettability of the working fluid for the heating layer 22, and can be calculated by the following equation:

$$\eta = \frac{b}{h} \times \frac{64v}{V}$$

wherein ρ is the viscosity of the working fluid, V is the velocity of the working fluid, and b and h are the width and height of the cross section of the working fluid channel, as described above.

If the working fluid channel 30 is designed according to the properties of the working fluid so that the hydro-resistance value Rr of the working fluid in the working fluid channel 30 is larger than 2, then the pressure wave generated in a working fluid chamber 25 of a ink-jet head unit will not be transmitted to the neighboring working fluid chambers 25. Thus, error printing operations can be prevented.

However, according to the experiment carried out by the inventor of the invention, in the case that the coefficient K is about 6 by design, and the coefficient η is between 0.0001 to 0.01 according to the viscosity and the velocity of the working fluid, the effect of preventing error printing operations will be further assured. So, it is recommended to design the working fluid channel 30 according to the above-mentioned values.

While this invention has been described with reference to a preferred embodiment, this description is not intended to be construed in a limiting sense. Various modifications and combinations of the embodiment will be apparent to persons skilled in the art upon reference to the description. It is therefore intended that the appended claims encompass any such modifications or embodiments.

What is claimed is:

1. An ink-jet head unit with bubble-driven flexible membrane, comprising:

a dielectric substrate;

a heating layer formed on said dielectric substrate, the heating layer including a resistor for converting electricity into thermal energy;

a heat dissipating layer formed on said heating layer, said heat dissipating layer comprising:

a first polysilicon layer, a metal layer formed on said first polysilicon layer, and a second polysilicon layer formed on said metal layer;

a working fluid chamber formed in said heat dissipating layer and corresponding to an area above said resistor for containing working fluid;

a nozzle plate formed on said heat dissipating layer and having an inner surface and an outer surface, the nozzle plate being formed with a nozzle;

an ink chamber formed in said nozzle plate for containing ink; and a flexible membrane formed between said heat dissipating layer and said nozzle plate to separate said working fluid chamber from said ink chamber, the flexible membrane including a polymeric adhesive layer formed on said heat dissipation layer, a barrier metal layer formed on said polymeric adhesive layer, and a protection layer formed on said barrier metal layer.

2. The ink-jet head unit according to claim 1, wherein said dielectric substrate comprises silicon.

3. The ink-jet head unit according to claim 1, wherein said heating layer is formed by an aluminum layer.

4. The ink-jet head unit according to claim 1, wherein said resistor comprises polysilicon.

5. The ink-jet heat unit according to claim 1, wherein said metal layer comprises:

a first chromium layer;

a brass layer formed on said fist chromium layer; and a second chromium layer formed on said brass layer.

6. The ink-jet head unit according to claim 1, wherein the depth of said metal layer is greater than half of the height of said working fluid chamber.

7. The ink-jet head unit according to claim 1, wherein said working fluid comprises a material selected from a group consisting xylene, toluene, heptane, ethylene alcohol, and alcohol.

8. The ink-jet head unit according to claim 1, wherein said nozzle plate comprises nickel.

9. The ink-jet head unit according to claim 1, further comprising:

a well-wettable layer overlaying the inner surface of said nozzle plate for maintaining moisture; and a poor-wettable layer overlaying the outer surface of said nozzle plate for ink repellent.

10. The ink-jet head unit according to claim 9, wherein said well-wettable layer comprises polyimidoums.

11. The ink-jet head unit according to claim 9, wherein said poor-wettable layer comprises tetra-fluorine-ethylene.

12. The ink-jet head unit according to claim 1, wherein said polymeric adhesive layer comprises polyimidoums.

13. The ink-jet head unit according to claim 1, wherein said barrier metal layer comprises chromium.

14. The ink-jet head unit according to claim 1, wherein said protection layer comprises polyimidoums.

15. An ink-jet head with bubble-driven flexible membrane, which comprises a plurality of ink-jet head units with bubble-driven flexible membrane according to claim 1, and a working fluid channel system formed in said heat dissipating layer for communicating with working fluid chamber of each of the ink-jet head units, wherein the hydro-resistance value of said working fluid channel is calculated by the equation of:

$$Rr = \eta \times \frac{l}{h \times b} + K,$$

wherein l is the length of the working fluid channel, h is the height of the cross section of the working fluid channel, b is the width of the cross section of the working fluid channel, K is a coefficient that depends on the number and the curvatures of the curves of the working fluid channel, η is a coefficient, with a dimension of length (meter), and can be calculated by the following equation:

$$\eta = \frac{b}{h} \times \frac{64v}{V}$$

wherein ρ is the viscosity of the working fluid and V is the velocity of the working fluid.

16. The ink-jet head according to claim 15, wherein:

said coefficient K is no less than 6.

17. The ink-jet head according to claim 15, wherein:

said coefficient η is in the range from 0.0001 to 0.01.

* * * * *